US011420089B2

(12) United States Patent
Ridge

(10) Patent No.: US 11,420,089 B2
(45) Date of Patent: Aug. 23, 2022

(54) POWER 360

(71) Applicant: Deshon L. Ridge, San Marcos, TX (US)

(72) Inventor: Deshon L. Ridge, San Marcos, TX (US)

( * ) Notice: Subject to any disclaimer, the term of this patent is extended or adjusted under 35 U.S.C. 154(b) by 78 days.

(21) Appl. No.: 16/946,466

(22) Filed: Jul. 27, 2020

(65) Prior Publication Data

US 2022/0023705 A1 Jan. 27, 2022

(51) Int. Cl.

| | |
|---|---|
| ***A63B 21/06*** | (2006.01) |
| ***A63B 21/00*** | (2006.01) |
| ***A63B 21/055*** | (2006.01) |

(52) U.S. Cl.

CPC ..... *A63B 21/4033* (2015.10); *A63B 21/055* (2013.01)

(58) Field of Classification Search

CPC ... A63B 22/20; A63B 21/055; A63B 21/4033; A63B 21/4043; A63B 69/06; A63B 2071/025; A63B 21/0058

See application file for complete search history.

(56) References Cited

U.S. PATENT DOCUMENTS

| | | | | |
|---|---|---|---|---|
| 9,597,544 | B1 * | 3/2017 | Emick | A63B 21/065 |
| 10,918,898 | B1 * | 2/2021 | Palacios | A63B 21/0603 |
| 2011/0251025 | A1 * | 10/2011 | Harker | A63B 21/0442 482/91 |
| 2013/0337977 | A1 * | 12/2013 | Kokenis | A63B 21/15 482/110 |
| 2015/0165258 | A1 * | 6/2015 | Januszek | A63B 21/0607 482/93 |
| 2017/0014668 | A1 * | 1/2017 | Haddad | B60C 1/00 |
| 2018/0015318 | A1 * | 1/2018 | Nelson | A63B 21/4035 |
| 2018/0140885 | A1 * | 5/2018 | Antunez | A63B 21/0601 |
| 2019/0224518 | A1 * | 7/2019 | Antunez | A63B 21/0004 |
| 2020/0054918 | A1 * | 2/2020 | Mecca | A63B 21/16 |

FOREIGN PATENT DOCUMENTS

| | | | | |
|---|---|---|---|---|
| GB | 2516269 A | * | 1/2015 | A63B 21/0004 |

* cited by examiner

*Primary Examiner* — Joshua T Kennedy

(57) ABSTRACT

A multifunctional fitness equipment that allows the user to perform a variety of exercises either indoors or outside. The fitness equipment enables the user to perform exercises with the use of weights or their own body weight for resistance and stability. The fitness equipment can be utilized as a sled in which the user can perform cardiovascular conditioning with use of a harness attached to it. In addition, the user can utilize a variety of attachments such as battle ropes, resistance bands, and punching bag to perform a variety of exercises. The fitness equipment is mobile and can also be used by multiple people at the same time.

1 Claim, 1 Drawing Sheet

POWER 360

BACKGROUND OF THE INVENTION

1. Field of the Invention

The present invention is a multi-functional fitness equipment that enables the user to perform a variety of exercises with or without the use of free weights or bands. The equipment can be used indoors or outdoors.

2. Description of Related Art Including Information Disclosed Under 37 CFR 1.97 and 1.98

Tires and similar products are known to be used in a variety of fitness programs such as cross-training.

BRIEF SUMMARY OF THE INVENTION

The Power 360 is a multi-functional fitness equipment that enables the user to perform a variety of exercises with or without the use of free weights or bands. For example, the user may perform exercises using free weights, either stationary or with movement, or utilizing resistance bands. Further, the equipment allows the user to perform cardiovascular conditioning with or without free weights as well as allowing the user to perform strength and cardiovascular conditioning on the invention by itself.

BRIEF DESCRIPTION OF THE SEVERAL VIEWS OF THE DRAWING(S)

DETAILED DESCRIPTION OF THE INVENTION

The present invention is a multi-functional fitness equipment device that allows a user to perform a variety of exercises either indoors or outside.

The top view (FIG. 1) and the side view (FIG. 2) show the main body of the device being a tire or being comprised of rubber material, both of which have the shape of a circular form (1).

Figure 1:
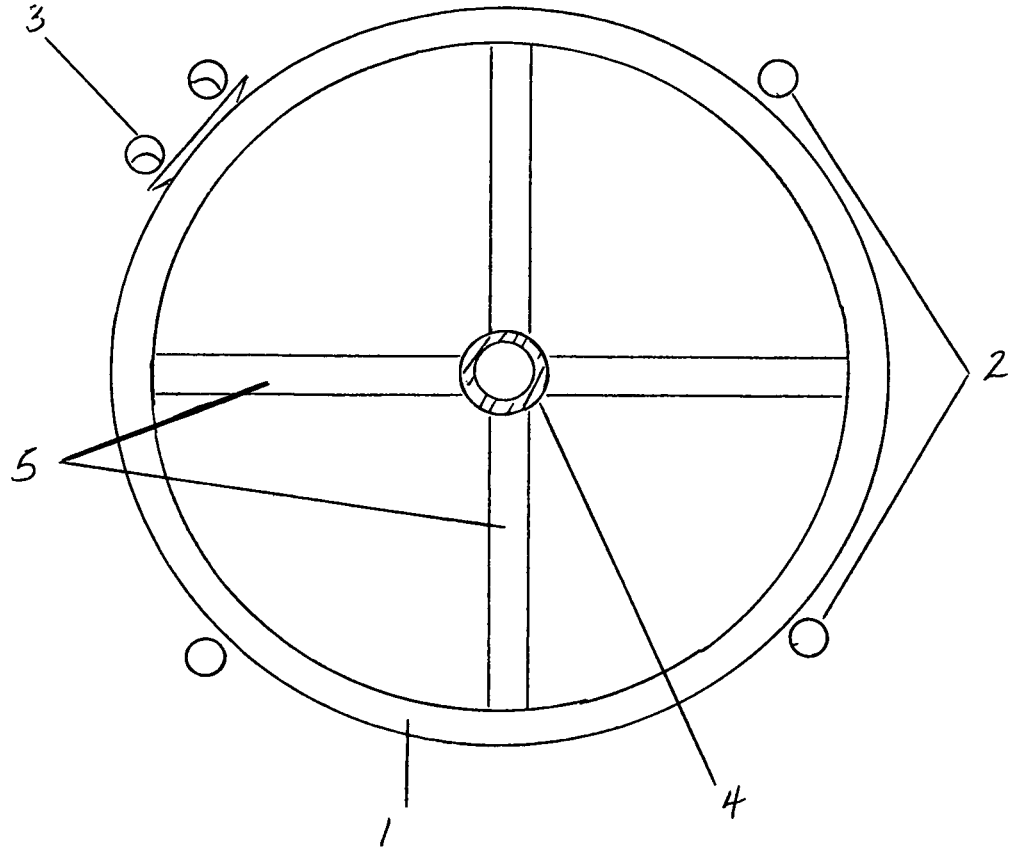
FIG. 1 shows a top view of the Power 360 exercise device.
Figure 2:
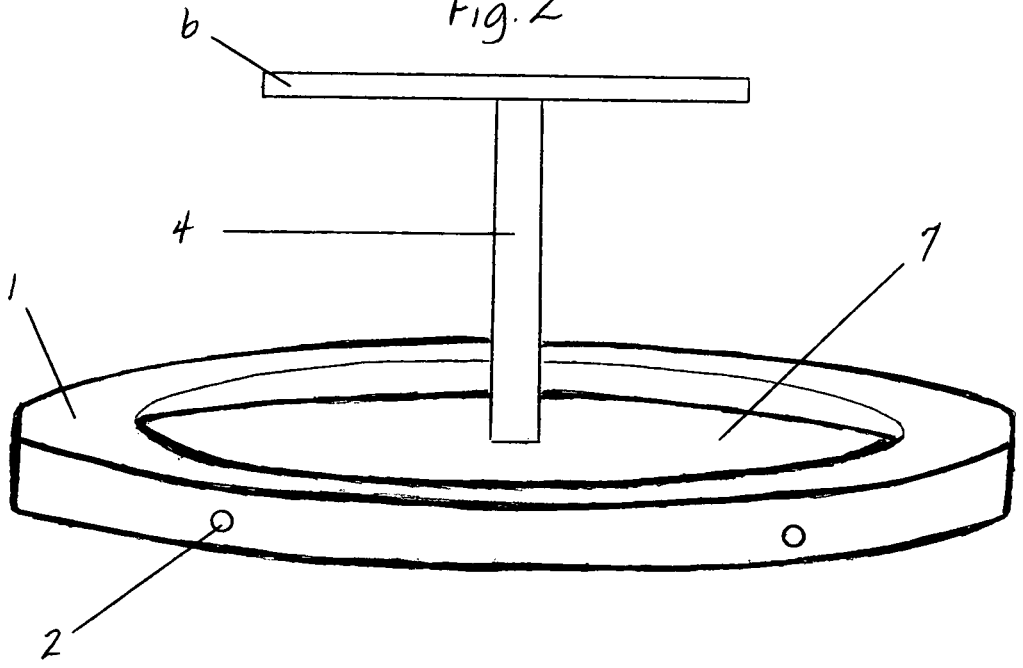
FIG. 2 shows a side view of the Power 360 exercise device.

Cross-bars (5) are made from metal, steel, or aluminum and are attached to an interior of the circular form and are connected to each other by connectors, welding, or the like. A floor flange (7) is mounted on top of the cross bars. FIG. 1 shows the floor flange (7) in position on top of the cross bars (5).

The device further comprises a detachable T-bar having a handle (6) and the connector pipe (4) which is removably attached to the cross bars (5). The T-bar handle enables the user to add free weights for resistance and stability and is also removable for different exercises to be performed with the device. Further, caster wheels (3) can be attached to the circular form to facilitate transportability.

The device comprises of attachment points (2) on the outer surface of the circular form. The attachment points allow for the fitness equipment to be utilized as a sled in which the user can perform cardiovascular conditioning with the use of an harness that can be attached to attachment points. The user can also attach resistance bands or battle ropes to the attachment points of the fitness equipment to perform a variety of exercises. The fitness equipment can also be used by multiple people at the same time.

The invention claimed is:

1. A multifunctional fitness device configured to allow a user to perform numerous exercised comprising:

a circular form made of tire or rubber material defining an opening there through;

two metal bars being mounted to the circular form within the opening; said metal bars intersecting to form a cross shape;

a floor flange mounted to said at least two metal bars;

a connector pipe removably attached to said metal bars at the intersection thereof in a transverse direction at a first end and having a handle attached at a second end;

attachments points on the outer surface of the circular form; and at least one wheel attached to the outer surface of the circular form configured to facilitate transport.

* * * * *